US006497527B2

(12) United States Patent
Kaufmann

(10) Patent No.: US 6,497,527 B2
(45) Date of Patent: Dec. 24, 2002

(54) LIQUID APPLICATOR IMPLEMENT

(75) Inventor: Rainer Kaufmann, Delmenhorst (DE)

(73) Assignee: Dataprint R. Kaufmann GmbH, Delmenhorst (DE)

( * ) Notice: Subject to any disclaimer, the term of this patent is extended or adjusted under 35 U.S.C. 154(b) by 0 days.

(21) Appl. No.: 09/839,390

(22) Filed: Apr. 20, 2001

(65) Prior Publication Data

US 2001/0016141 A1 Aug. 23, 2001

Related U.S. Application Data

(62) Division of application No. 09/714,019, filed on Nov. 16, 2000, which is a division of application No. 09/011,842, filed as application No. PCT/DE96/01530 on Aug. 12, 1996, now Pat. No. 6,183,155.

(30) Foreign Application Priority Data

Aug. 14, 1995 (DE) ..... 195 29 865

(51) Int. Cl.[7] ..... B43K 5/00

(52) U.S. Cl. ..... 401/198; 401/199

(58) Field of Search ..... 401/199, 198

(56) References Cited

U.S. PATENT DOCUMENTS

| | | | | |
|---|---|---|---|---|
| 535,588 | A | 3/1895 | Horton | |
| 1,166,896 | A | 1/1916 | Garvey | |
| 1,387,754 | A | 8/1921 | Bates | |
| 2,740,979 | A | 4/1956 | Bridy | 15/134 |
| 3,113,336 | A | 12/1963 | Langnickel | |
| 3,397,939 | A | 8/1968 | Berry | 401/198 |
| 3,457,014 | A | 7/1969 | Ward | 401/41 |
| 3,479,122 | A | 11/1969 | Funabashi | |
| 3,501,225 | A | 3/1970 | Martin et al. | |
| 3,873,218 | A | 3/1975 | Yoshida | 401/292 |
| 3,905,709 | A | 9/1975 | Bok | |
| 3,922,100 | A | 11/1975 | Saito | |
| 3,993,409 | A | 11/1976 | Hart | |
| 4,238,162 | A | 12/1980 | Sherwood | 401/198 |
| 4,341,482 | A | 7/1982 | Wollensak | 401/251 |
| 4,382,707 | A | 5/1983 | Anderka | 401/198 |
| 4,496,258 | A | 1/1985 | Tanaka et al. | |
| 4,549,828 | A | 10/1985 | Anderka et al. | 401/258 |
| 4,556,336 | A | 12/1985 | Sano et al. | |
| 4,588,319 | A | 5/1986 | Neimeyer | |
| 4,662,769 | A | 5/1987 | Goh | 401/259 |
| 4,671,692 | A | 6/1987 | Inaba | 401/199 |
| 4,712,937 | A | 12/1987 | Schmidt et al. | |
| 4,764,045 | A | 8/1988 | Tschawow | 401/198 |
| 4,770,558 | A | 9/1988 | Frietsch | |
| 4,923,317 | A | 5/1990 | Bishop et al. | |

(List continued on next page.)

FOREIGN PATENT DOCUMENTS

| | | |
|---|---|---|
| DE | 1 269 010 | 1/1969 |
| DE | 1 511 395 | 7/1969 |
| DE | 1 461 588 | 8/1971 |
| DE | 2 124 298 | 11/1972 |

(List continued on next page.)

OTHER PUBLICATIONS

German disclosure document entitled "Docht–Schreiber" dated Jul. 10, 1963.

Evaluation dated Aug. 3, 1989, by Institute Textile ITF.

*Primary Examiner*—David J. Walczak

(74) *Attorney, Agent, or Firm*—Squire, Sanders & Dempsey, L.L.P.

(57) ABSTRACT

A liquid applicator implement includes a container for freely movable liquid (6), a capillary storage (16) for temporarily receiving liquid upon a change in air pressure and/or temperature of the environment, an applicator element (12) and a capillary air inlet for compensation in respect of liquid taken from the container. A passage (20) for conveying the liquid entirely or partially bridges over the distance between the container with the liquid (6) and the applicator element (12). The passage is not directly in communication with the storage (16) and it is of lower capillarity than the storage (16).

13 Claims, 10 Drawing Sheets

U.S. PATENT DOCUMENTS

| | | | | |
|---|---|---|---|---|
| 5,087,144 | A | 2/1992 | Wada et al. | |
| 5,102,251 | A | 4/1992 | Kaufmann | |
| 5,124,200 | A | 6/1992 | Mallonee | 428/296 |
| 5,163,767 | A | 11/1992 | Lucas | |
| 5,172,995 | A | 12/1992 | Felgentreu | 401/258 |
| 5,192,154 | A | 3/1993 | Moeck | |
| 5,211,495 | A | 5/1993 | Jozat et al. | 401/217 |
| 5,290,116 | A | 3/1994 | Chang | |
| 5,352,052 | A | 10/1994 | Kaufmann | |
| 5,362,168 | A | 11/1994 | Abe et al. | |
| 5,407,448 | A | 4/1995 | Brandt et al. | |
| 5,420,615 | A | 5/1995 | Witz et al. | 346/140 |
| 5,427,463 | A | 6/1995 | Bastiansen et al. | 401/134 |
| 5,443,322 | A | 8/1995 | Jozat et al. | 401/195 |
| 5,445,466 | A | 8/1995 | Mukunoki | |
| 5,480,250 | A | 1/1996 | Birden | |
| 5,556,215 | A | 9/1996 | Hori | |
| 5,622,857 | A | 4/1997 | Goffe | 435/378 |
| 5,897,264 | A | 4/1999 | Baudino | 401/199 |
| 5,927,885 | A | 7/1999 | Duez et al. | 401/199 |
| 5,938,362 | A | 8/1999 | Bastiansen | 401/209 |
| 5,965,468 | A | 10/1999 | Marmon et al. | 442/340 |
| 5,971,646 | A | 10/1999 | Chavatte et al. | 401/199 |
| 6,039,486 | A | 3/2000 | Breslin | 401/88 |
| 6,062,758 | A | 5/2000 | Maurer et al. | 401/199 |
| 6,089,776 | A | 7/2000 | Kaufmann | |
| 6,095,707 | A | 8/2000 | Kaufmann | 401/199 |
| 6,183,155 | B1 | 2/2001 | Kaufmann | |

FOREIGN PATENT DOCUMENTS

| | | | |
|---|---|---|---|
| DE | 24 24 918 | | 12/1975 |
| DE | 2754338 | | 12/1977 |
| DE | 28 44 886 | | 8/1979 |
| DE | 28 08 910 | | 9/1979 |
| DE | 2434378 | | 3/1986 |
| DE | 3433393 | | 3/1986 |
| DE | 3434188 | | 3/1986 |
| DE | 3502592 | | 7/1986 |
| DE | 3504462 | | 8/1986 |
| DE | 3642037 | | 6/1988 |
| DE | 3903 606 | A1 | 2/1989 |
| DE | 38 15 882 | | 12/1989 |
| DE | 3824941 | | 1/1990 |
| DE | DE 4115685 | A1 | 5/1991 |
| DE | 93/00989 | | 11/1992 |
| DE | 44 03 771 | | 8/1995 |
| DE | 19610644 | A1 | 9/1997 |
| DE | 298 23 054 | | 6/1999 |
| DE | 299 10 459 | | 10/2000 |
| DE | 199 30 540 | | 1/2001 |
| EP | 85115513.5 | | 12/1985 |
| EP | 86109151 | | 7/1986 |
| EP | 89105388.0 | | 4/1987 |
| EP | 90111302 | | 6/1990 |
| EP | 90306121 | | 6/1990 |
| EP | 91106645 | | 4/1991 |
| EP | 91115307 | | 9/1991 |
| EP | 92401454 | | 5/1992 |
| EP | 0 899 128 | A1 | 8/1998 |
| EP | 00110952.9 | | 5/2000 |
| FR | 87610 | | 1/1965 |
| FR | 422 575 | | 4/1965 |
| FR | 79 19412 | | 7/1979 |
| FR | 83 04258 | | 3/1983 |
| GB | 941439 | | 11/1964 |
| GB | 2205280 | A | 5/1988 |
| GB | 2241882 | A | 2/1991 |
| JP | 48-36844 | | 2/1973 |
| JP | 59-12999 | | 4/1984 |
| JP | 2-48377 | | 4/1990 |
| NL | 7701595 | | 8/1978 |
| NL | 7907389 | | 4/1981 |
| WO | 93/01796 | | 7/1993 |
| WO | PCT/US91/04622 | | 6/1994 |
| WO | PCT/DE96/01530 | | 8/1996 |
| WO | PCT/EP96/04223 | | 9/1996 |
| WO | PCT/CH00433 | | 9/1999 |
| WO | 00/17575 | | 1/2001 |

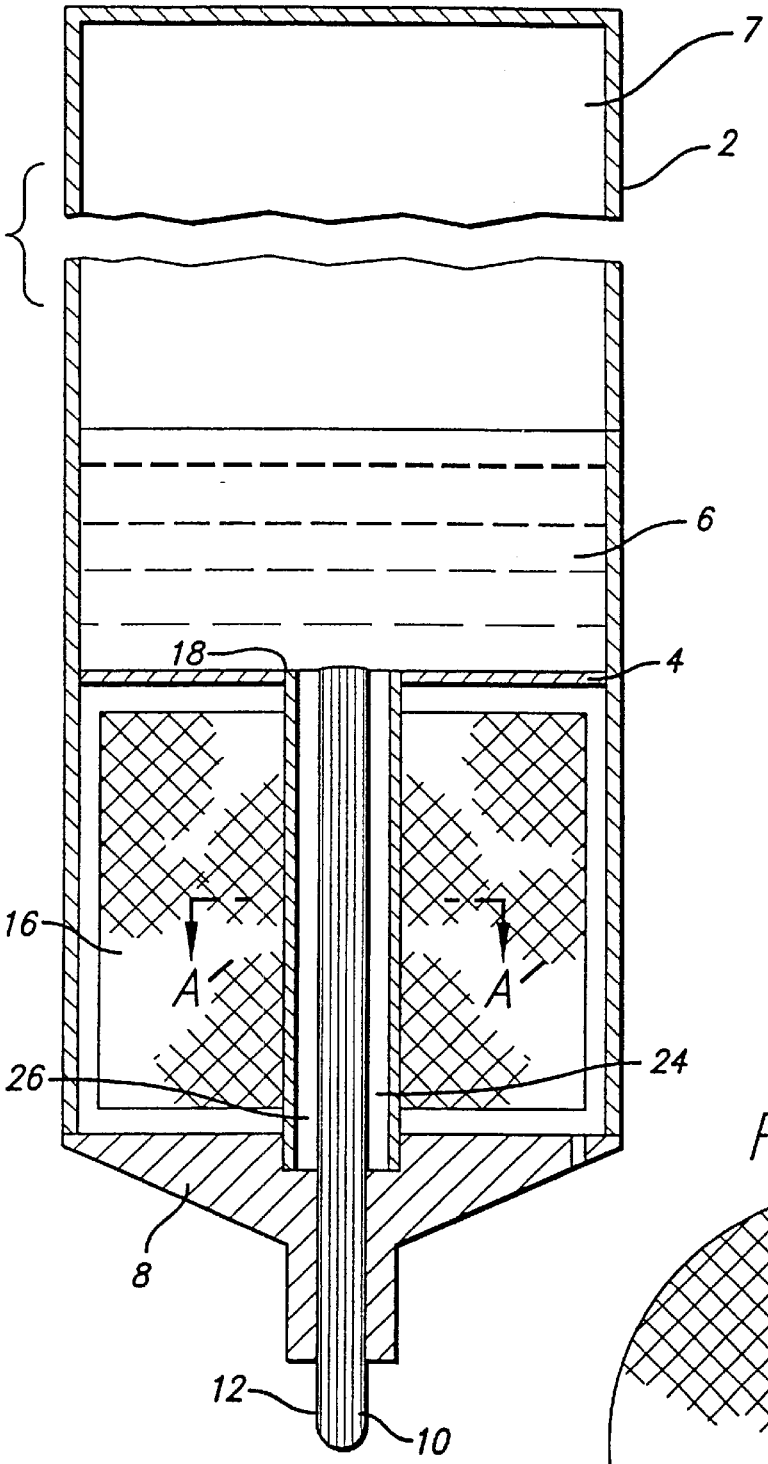
FIG. 4
FIG. A–A′
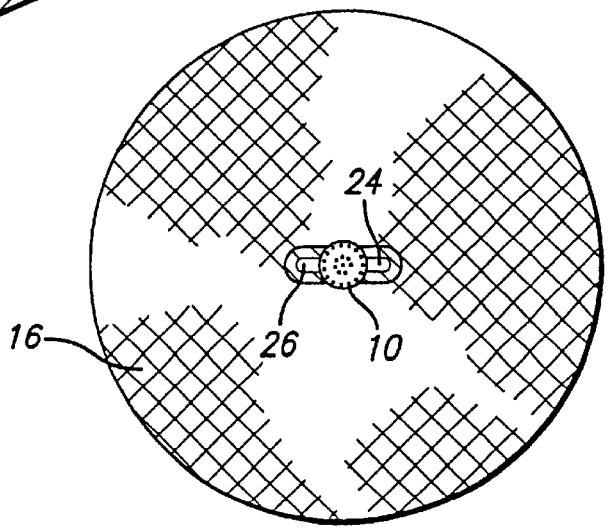

LIQUID APPLICATOR IMPLEMENT

CROSS-REFERENCES TO RELATED APPLICATIONS

This is a divisional application of Ser. No. 09/714,019, filed on Nov. 16, 2000, which itself is a divisional application of Ser. No. 09/011,842, filed on Feb. 13, 1998, now U.S. Pat. No. 6,183,155 B1, filed on May 26, 1998 and issued Feb. 6, 2001, which is based on and is a 371 International Application No. PCT/DE96/01530, filed on Aug. 12, 1996, which claims priority of German Application 195 29 865.9, filed on Aug. 14, 1995.

BACKGROUND OF THE INVENTION

1. Field of Invention

The invention concerns an implement for applying a liquid to a support by means of an applicator element.

2. Description of the Related Art

An implement is known from DE 41 15 682 and will now be described with reference to FIG. 11.

Provided within a casing 2 is a divider wall 4, above which a supply of freely movable liquid 6 is accommodated in the casing. Above the liquid 6 is a volume of air 7 which increasingly replaces the liquid as it is discharged.

At its lower end the casing 2 has a tapering front portion 8 with a through opening in which is held a wick 10 terminating in a writing tip 12 serving as an applicator element. Extending laterally beside the wick 10 through the front portion 8 is a vent bore 14. A storage means 16 of capillary material which closely embraces the wick 10 is accommodated in the space between the front portion 8 and the divider wall 4. The wick 10 completely fills an opening 18 provided in the divider wall 4 so that only the wick 10 projects into the liquid 6.

The capillarities of the wick 10 and the storage means 16 are matched to each other in such a way that the capillarity of the storage means 16 is less than that of the wick 10. It will be appreciated that the wick 10 does not involve a uniform degree of capillarity as it has larger and smaller spacings between its fibers or includes statistically distributed pores.

The important consideration is that the mean capillarity of the wick 10 in the region of the opening 18 is greater than the mean capillarity of the storage means 16. That ensures that, when passing the implement over a support which is to be written upon with the writing tip 12, liquid is sucked by capillary action through the wick 10 out of the supply of liquid in the casing 2 on to the support and at the same time air passes into the interior of the casing through the larger pores in the wick 10, within the opening 18, in order to replace the liquid which has been discharged in the writing operation. Because the storage means 16 involves a lower level of capillarity or larger capillaries in comparison with the capillaries of the wick 10 which serve for the feed of air to the liquid 6, the storage means 16 which is directly in contact with the wick 10 is not sucked full with liquid so that its volume is available as a buffer volume if liquid is urged out of the supply of liquid into the wick for example due to thermal expansion of the air volume 7. In that way the implement of FIG. 11 is extremely leak-proof in spite of a very large supply of liquid.

A particularity of that device is that the liquid to be applied to a support has to flow through the entire wick 10, which naturally gives rise to a high level of flow resistance which limits the amount of ink issuing from the writing tip 12. In practical operation that has the result from time to time that, when writing quickly or when quickly applying liquid, the implement does not give a satisfactory writing or application trace or image on the support.

SUMMARY OF THE INVENTION

It is an object of the invention to improve a liquid applicator implement as mentioned above as to permit a satisfactory applying of liquid to a support under widely varying conditions and using considerably different liquids.

A solution of this object is provided with an implement for applying liquid to a support including: a container for a freely movable liquid; a capillary storage means for temporarily receiving liquid upon a change in air pressure and/or temperature of the environment; an applicator element formed as a writing, drawing or brush tip or a print element; a capillary air inlet for compensation of liquid taken from the container; characterized in that a passage for conveying bridges partially or entirely over the distance between the container with liquid and the applicator element which passage is not directly in communication with the storage means and is of a lower capillary than that of the storage means.

In the implement according to the invention the liquid does not have to cover a long distance through a medium with a high level of capillarity, but is passes through a passage of low capillarity directly to the applicator element which therefore can be of a correspondingly short configuration and which no longer has a high level of flow resistance in regard to the liquid to be applied to a support, even with a high degree of capillarity.

Accordingly even large amounts of liquid can be applied to the support in a short time with the implement according to the invention, that is to say it is possible to write quickly, print very fast and so on.

Appended subclaims are directed toward advantageous embodiments of the inventive implement.

BRIEF DESCRIPTION OF THE DRAWINGS

The invention will now be described by way of example with reference to the accompanying diagrammatic drawings in which.

DETAILED DESCRIPTION OF THE EMBODIMENTS

Figure 1:
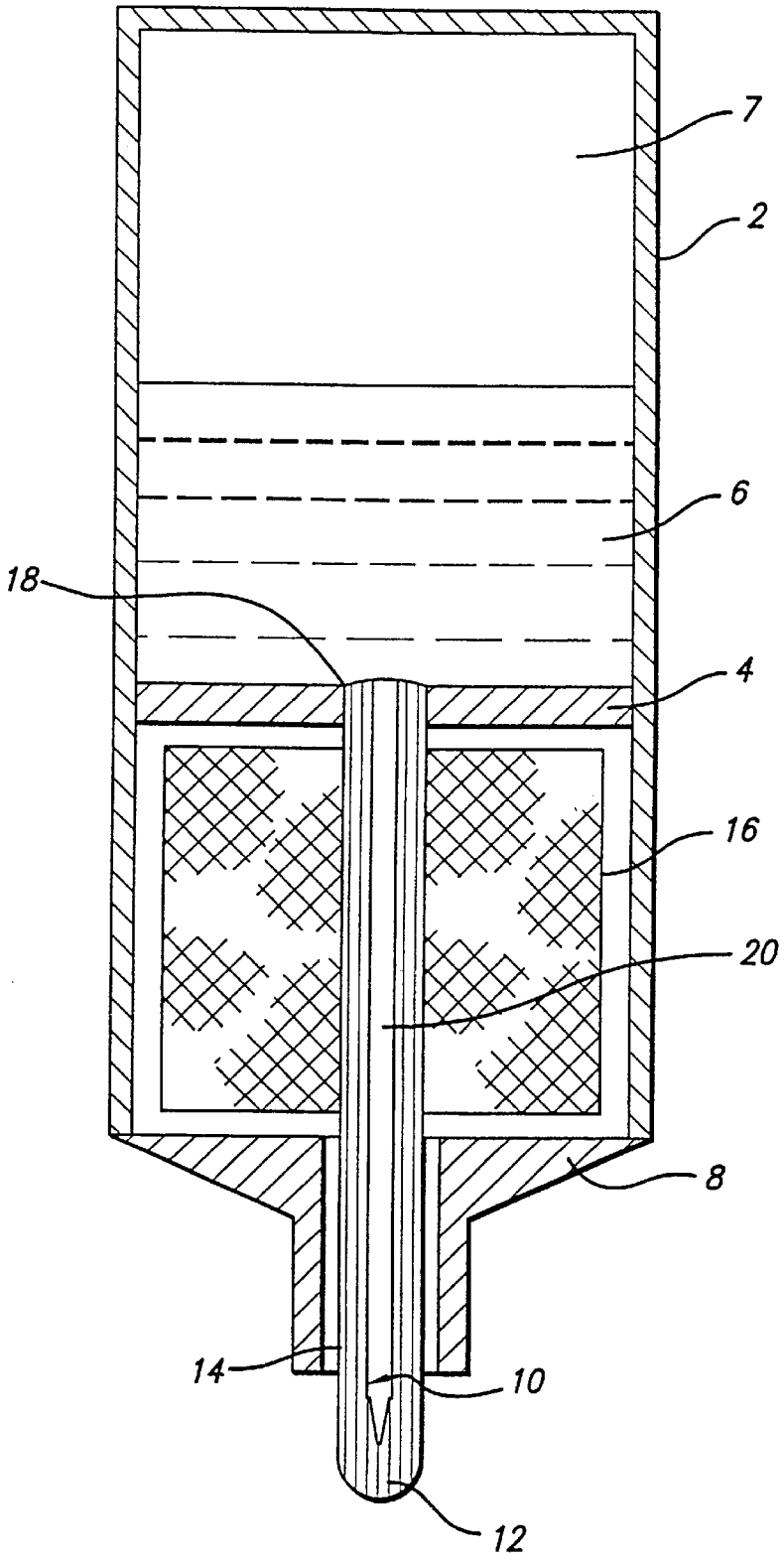
FIG. 1 is a view in cross-section through a first embodiment of an implement according to the invention.

Referring to FIG. 1, a writing implement to the operated by hand comprises a casing 2 with a divider wall. Above the divider wall 4 there is a supply of freely movable liquid 6, for example writing ink, above which there is in turn an air volume 7.

Within casing 2 above divider wall 4 there is space for accommodating a large volume of liquid 6 (10 ml or more).

Figure 11:
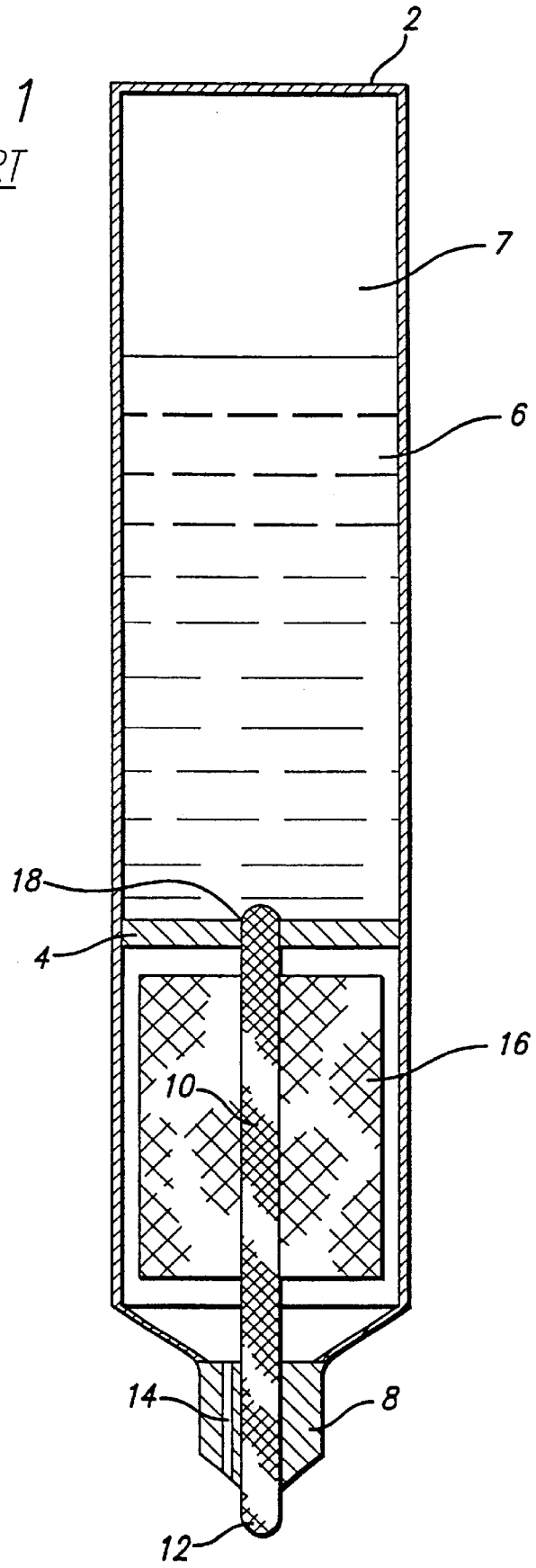
FIG. 11 PRIOR ART
FIG. 11 is a view in cross-section through the known implement already described above.

At the bottom the casing 2 terminates in a front portion 8 in which a wick 10 is held, the wick 10 terminating in an applicator or writing tip 12. Extending laterally beside the wick 10 through the front portion 8 is at least one vent bore 14 or a vent passage. The wick 10 extends through a storage means 16 of capillary material which is disposed in the casing 2 below the divider wall 4, into an opening 18 which is provided in the divider wall 4, and which it completely fills. The storage means 16 embraces the wick 10 in such a way that it is at least in part in direct contact with the wick 10. As in the FIG. 11 implement the capillarities of the storage means 16 and the wick 10 are matched to each other in such a way that the mean capillarity of the storage means 16 is less than that of the wick 10, while the larger capillaries of the wick 10, within the opening 18, serve for the introduction of air into the supply of liquid 6 in order to replace by air the liquid discharged by the writing tip 12. There is a considerable degree of freedom of choice for the material of the wick 10. It may comprise for example acrylonitrile polymer, polyester or nylon fibers, or a capillary component which is produced in a mould. The storage means 16 may comprise fibrous, foam or plate-like material with capillary gaps therebetween.

In contrast to the state of the art the wick 10 is formed in its interior with a blind passage 20 which extends axially directly from the liquid 6 to the writing tip 12. The dimensioning of the passage 20 is such that its capillarity is markedly less than that of the storage means 16 so that liquid passes through the passage 20 directly from the liquid supply 6 to the writing tip 12.

It is advantageous if the capillarity of the passage 20, when using normal writing inks, is less than that of a circular capillary of a diameter of 0.1 mm, preferably smaller than that of a capillary of a diameter of 0.5 mm. It is further advantageous if at the end of the passage 20 which is towards the writing tip 12 the wick 10 has capillaries whose capillarity is larger than that of the capillary air inlet which is disposed for example within the wick 10 in the region of the opening 18 and/or between the wick 10 and the inside wall of the opening 18 or at any location of the wick 10 between the divider wall 4 and the writing tip 12. In the latter case the air passes transversely through the wick 10 directly into the passage 20. That ensures that, when liquid issues from the writing tip 12 when the implement is used for writing on a support, air bubbles are sucked in through the opening 18 into the volume of the liquid 6.

The embodiment illustrated in FIG. 1 in which the passage 20 is completely enclosed by the capillary material of the wick 10 ensures a reliable feed of liquid to the passage 20 on the one hand while on the other hand the storage means 16 which with its material of low capillarity is in direct contact with the wick 10 can reliably come into operation.

In the described embodiment of FIG. 1 the blind passage 20 is produced by a procedure whereby a per se known wick is received in a device having an internal bore whose diameter corresponds to that of the wick and a bar corresponding to the passage 20 to be formed is driven into the wick, in which case the wick advantageously comprises thermoplastic material and is heated to a temperature of for example 80° C. during the operation of driving the bar into the wick.

Figure 2:
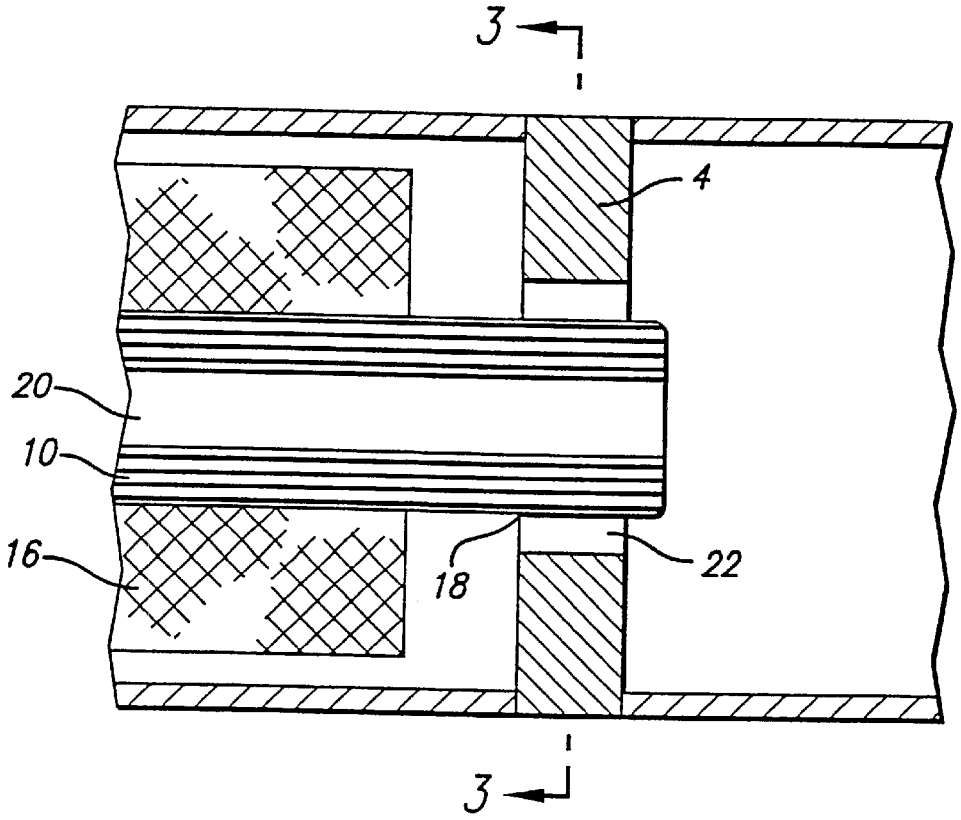
FIG. 2 is a detail view on an enlarged scale of the implement shown in FIG. 1.
Figure 3:
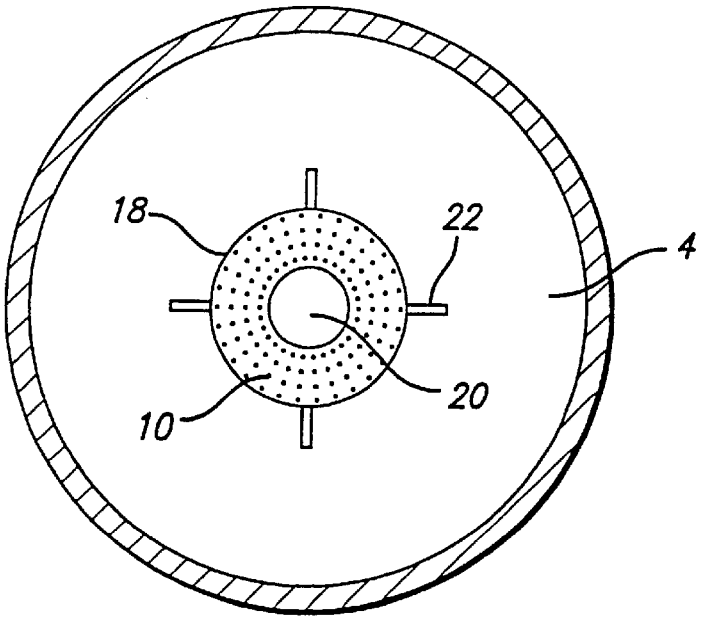
FIG. 3 is a view in section taken along line III—III in FIG. 2, FIGS. 4 to 8 are cross-sectional views of different embodiments of the implement according to the invention.

FIG. 2 is a view on an enlarged scale of the embodiment of FIG. 1, turned through 90° and with a modified configuration for the opening 18. In this embodiment, as can be seen in particular from FIG. 3, the opening 18 is provided with slots 22 affording well-defined capillaries which serve for the feed of air into the liquid space 6 above the divider wall 4 in FIG. 1 or to the right of the divider wall 4 in FIG. 2. When only the larger pores of the wick 10 are used to provide for the feed of air, the capillarity may be somewhat too large, that is to say the flow of ink may be too slight, for some situations of use. In contrast the slots 22 can ensure an accurately defined capillarity which is lower than that of the wick 10 but greater than that of the storage means 16.

The embodiment shown in FIG. 4 does not have a passage formed by a blind passage 20 within the wick 10, as in the embodiment of FIG. 1, but by two blind passages 24 and 26 defined within tube portions which are of U-shape in cross-section and which, extending along the wick 10, lead from the divider wall 4 into the portion 8 and feed liquid directly to the lower region of the wick 10. Otherwise the embodiment of FIG. 4 corresponds in terms of its function to the embodiment shown in FIG. 1, the passages 24, 26 only extending outside the wick 10 but directly adjoining same.

It is advantageous if the capillary of the passage 20, when using normal writing inks, is less than that of a circular capillary of a diameter of 0.1 mm, preferably smaller than that of a capillary of a diameter of 0.5 mm. It is further advantageous if at the end of the passage 20 which is towards the writing tip 12 the wick 10 has capillaries whose capillarity is larger than that of the capillary air inlet which is disposed for example within the wick 10 in the region of the opening 18 and/or between the wick 10 and the inside wall of the opening 18 or at any location of the wick 10 between the divider wall 4 and the writing tip 12. In the latter case the air passes transversely through the wick 10 directly into the passage 20. That ensures that, when liquid issues from the writing tip 12 when the implement is used for writing on a support, air bubbles are sucked in through the opening 18 into the volume of the liquid 6.

As is immediately apparent from FIGS. 1 and 4, the passages 20 in FIG. 1 and 24 and 26 in FIG. 4 are of considerable axial length which in normal writing implements is in the range that is at least greater than 0.5 cm whereby it is possible to circumvent the flow resistant of the wick 10 or the total flow resistance for the liquid to be applied can be considerably reduced.

Figure 6:
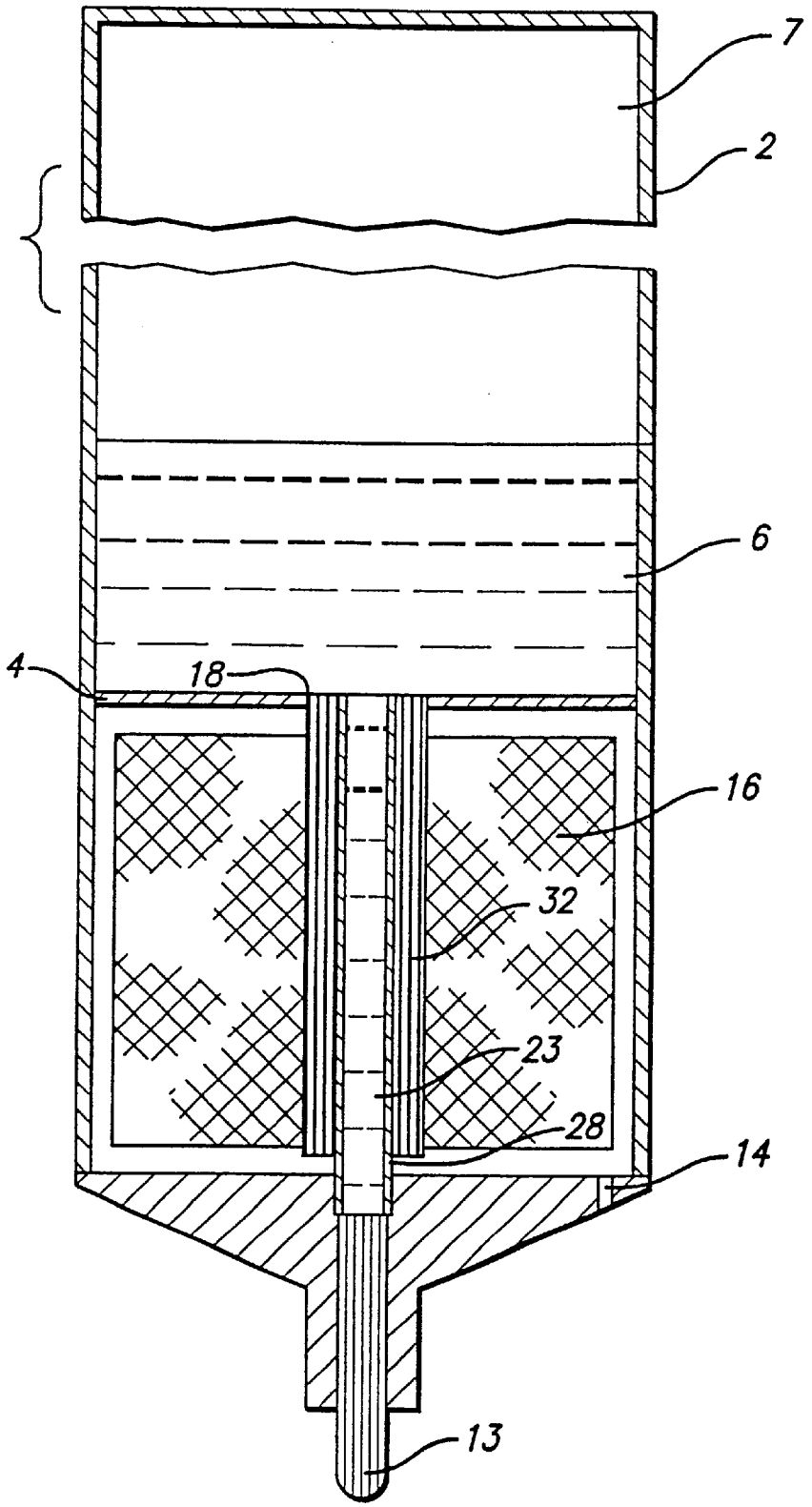

The embodiment of FIG. 6 does not have a wick which leads directly from the supply of liquid 6 to the writing tip 13. A tube portion 28 of material which is impervious to the liquid leads from the opening 18 into the front portion 8 and there feeds ink directly to the writing tip 13 held in the front portion 8, through a passage 29 formed in the interior of the tube portion 28. At their junction the tube portion 28 and the writing tip 13 are advantageously sealingly enclosed by the front portion 8. Arranged around the tube portion 28 is a hollow wick 32 which directly adjoins the capillary material of the storage means 16 and extends from the opening 18. The capillarities are so matched that the writing tip 13 which is in the form of a portion in the FIG. 6 embodiment is greater than that of the hollow wick 32, at least in the opening 18 which in turn is greater than that of the storage means 16. In that way the part of the hollow wick 32, which is in the opening 18, performs the function of feeding air to the supply of liquid 6 and charging the storage means 16 with a buffer liquid volume in the event of a rise in pressure in the air volume 7, for example upon an increase in temperature.

Figure 5:
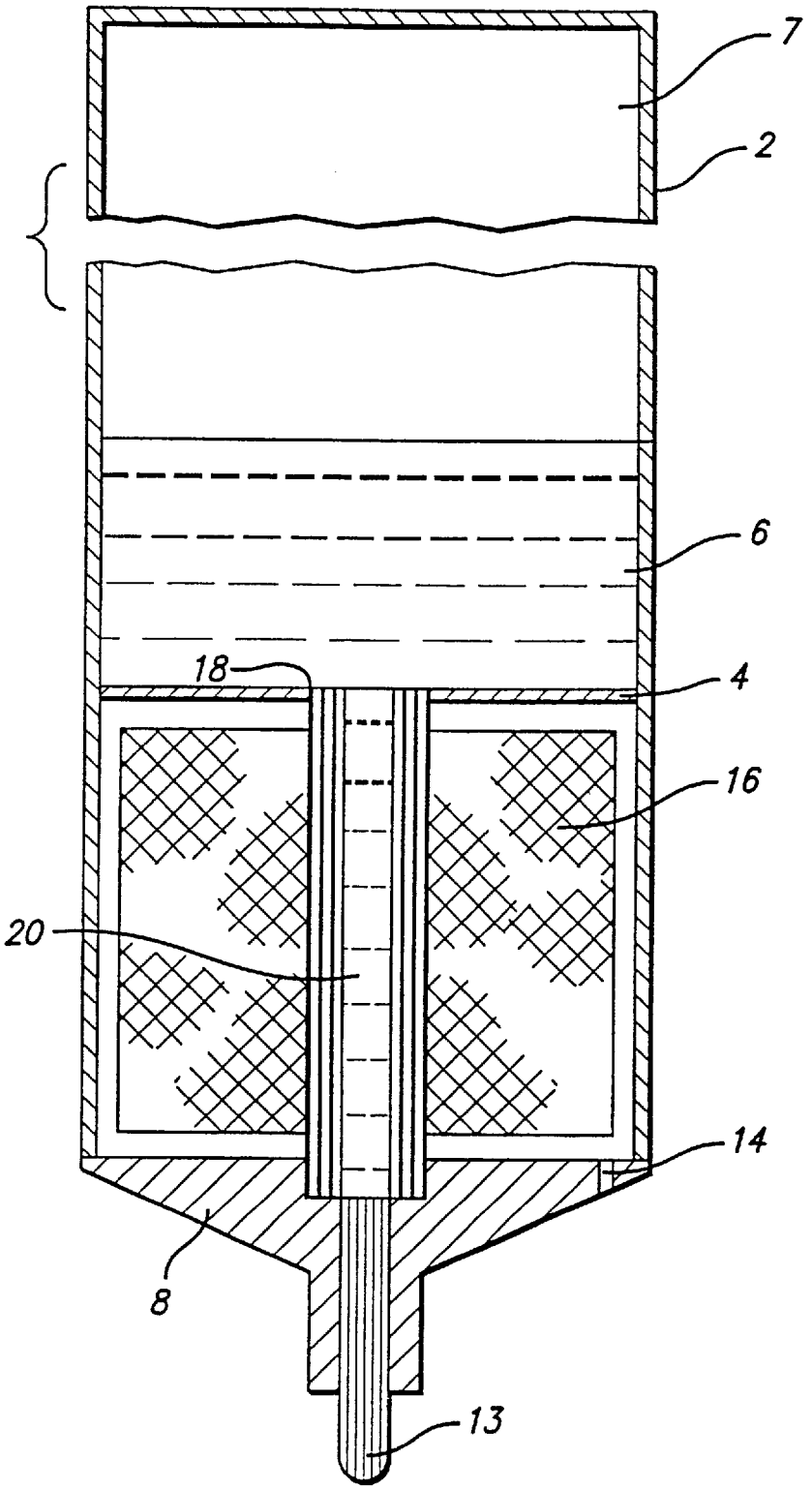

The embodiment of FIG. 5 differs from that of FIG. 1 insofar as the wick is of a two-part nature, namely in the form of a hollow wick 11 leading to an applicator or writing tip 13. The two parts 11 and 13 are advantageously sealingly enclosed at their junction by the front portion 8 so that the liquid reliably passes directly into the writing tip 13 through the passage 20. In the illustrated embodiment the vent bore 14 is disposed at a location in the front portion 8, remote from the writing tip 13. It will be appreciated that venting or air intake may occur at any suitable location, for example also through larger capillaries of the writing tip 13, directly into the passage 20.

The embodiment of FIG. 6 does not have a wick which leads directly from the supply of liquid 6 to the writing tip 13. A tube portion 28 of material which is impervious to the liquid leads from the opening 18 into the front portion 8 and there feeds ink directly to the writing tip 13 held in the front portion 8, through a passage 29 formed in the interior of the tube portion 28. At their junction the tube portion 28 and the writing tip 13 are advantageously sealingly enclosed by the front portion 8. Arranged around the tube portion 28 is a hollow wick 32 which directly adjoins the capillary material of the storage means 16 and extends from the opening 18. The capillarities are so matched that the writing tip 13 which is in the form of a wick portion in the FIG. 6 embodiment is greater than that of the hollow wick 32, at least in the opening 18 which in turn is greater than that of the storage means 16. In that way the part of the hollow wick 32, which is in the opening 18, performs the function of feeding air to the supply of liquid 6 and charging the storage means 16 with a buffer liquid volume in the event of a rise in pressure in the air volume 7, for example upon an increase in temperature.

Figure 7:
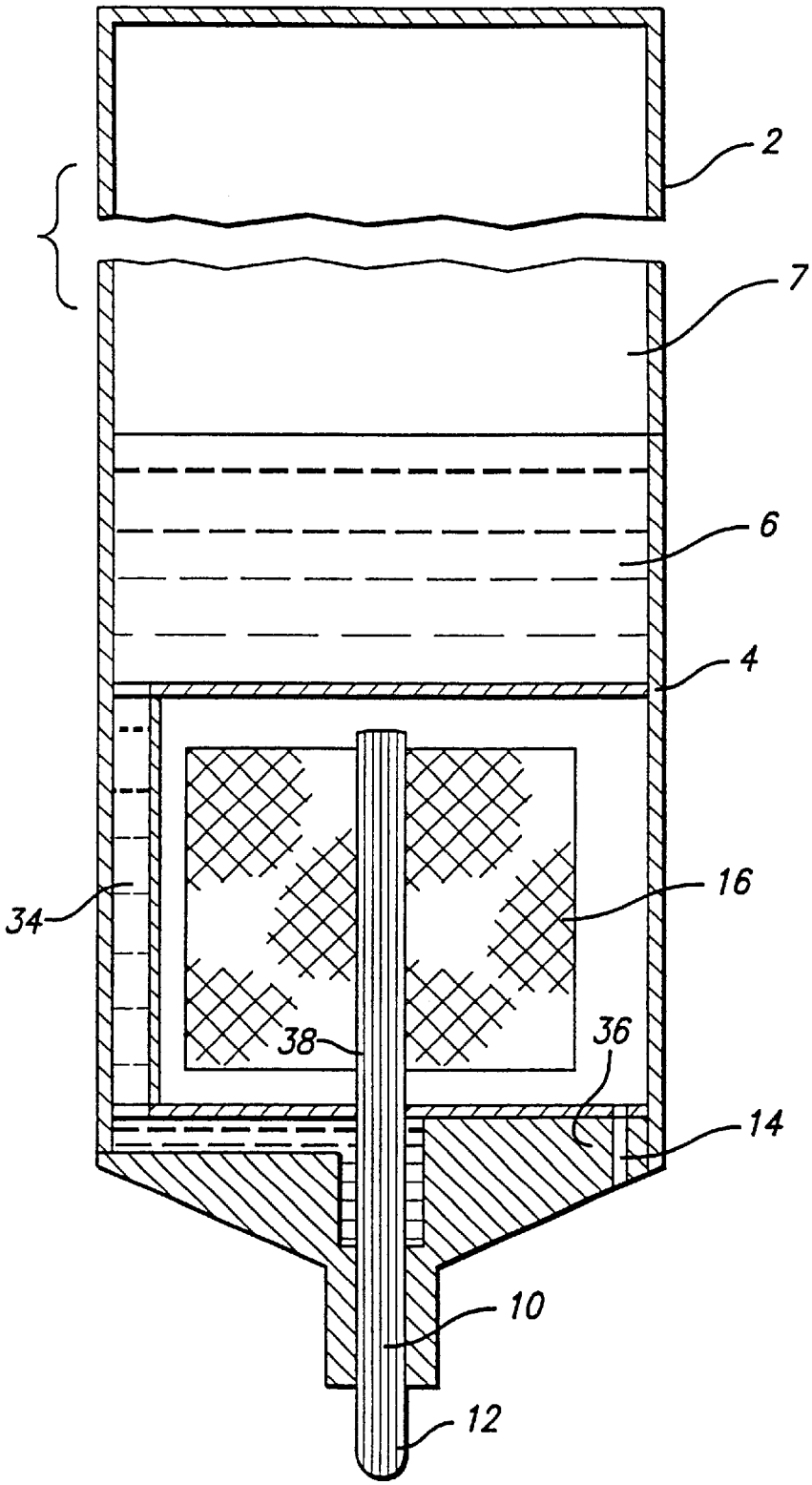

In the embodiment shown in FIG. 7 a passage 34 leads directly from the supply of liquid 6 into a central region of the wick 10 which terminates downwardly in the writing tip 12 and which is connected upwardly to the capillary storage means 16 through a further divider wall 36 in the casing 2.

The feed of air to the supply of liquid 6 occurs through the vent bore 14 into the space in which the storage means 16 is arranged and from there through the larger pores of the part of the wick 10, which is in an opening 38 in the further divider wall 36, into the passage 34. The relationships between the individual capillarities correspond to those of the embodiment of FIG. 1, the opening 38 performing the function of the opening 18 of the embodiment of FIG. 1.

Figure 8:
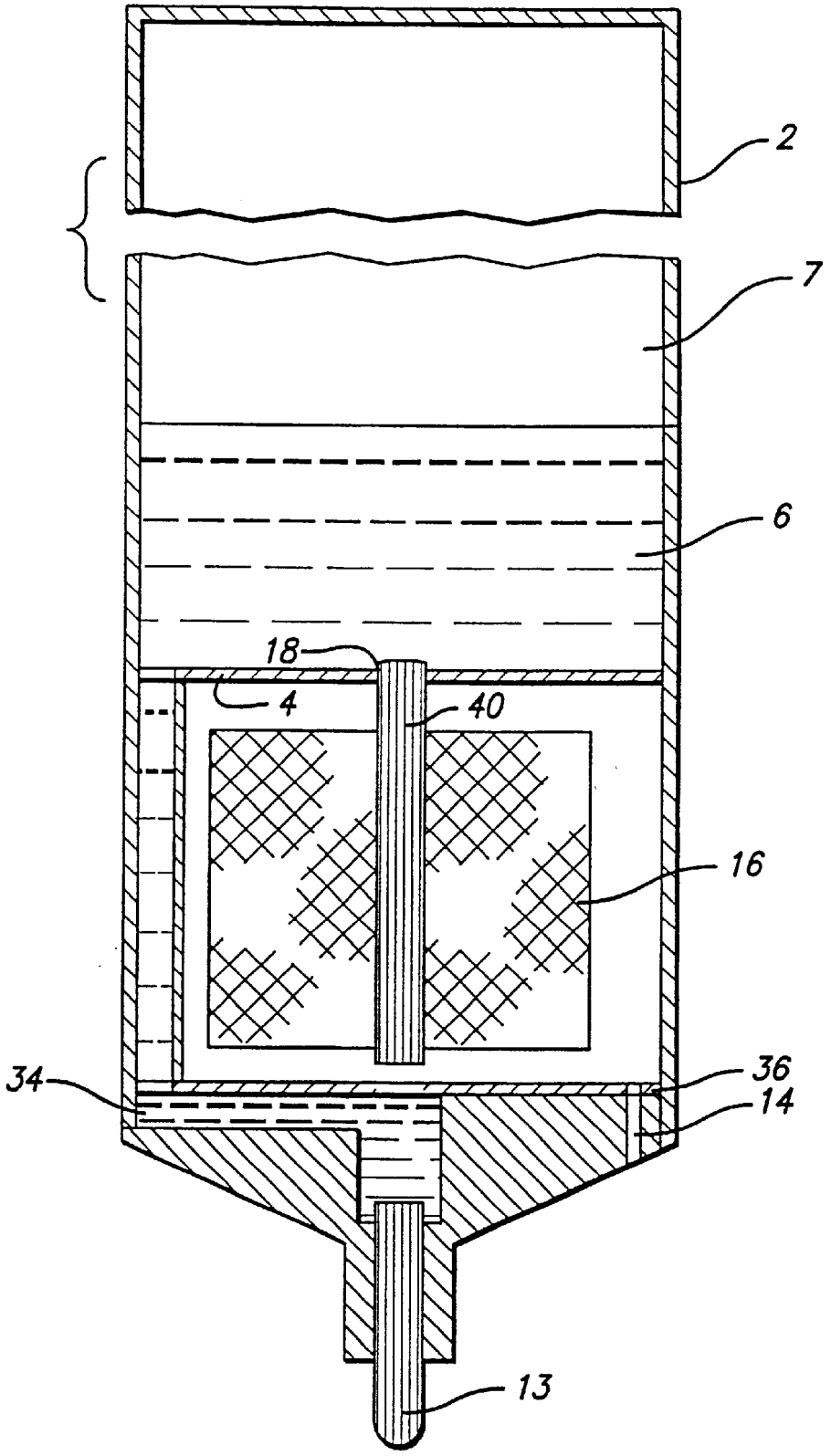

The embodiment of the implement shown in FIG. 8 corresponds to that of FIG. 6, but here the passage 29 in FIG. 6 is replaced by a passage 34 in FIG. 8 and the hollow wick 32 in FIG. 6 is replaced by a wick portion 40. Venting occurs through the capillaries of the part of the wick portion 40, which is in the opening 18, wherein the capillarity of the wick portion 40 must again be less than that of the writing tip 13 but greater than that of the storage means 16 so that under normal conditions the storage means 16 does not suck itself full of ink.

Figure 9:
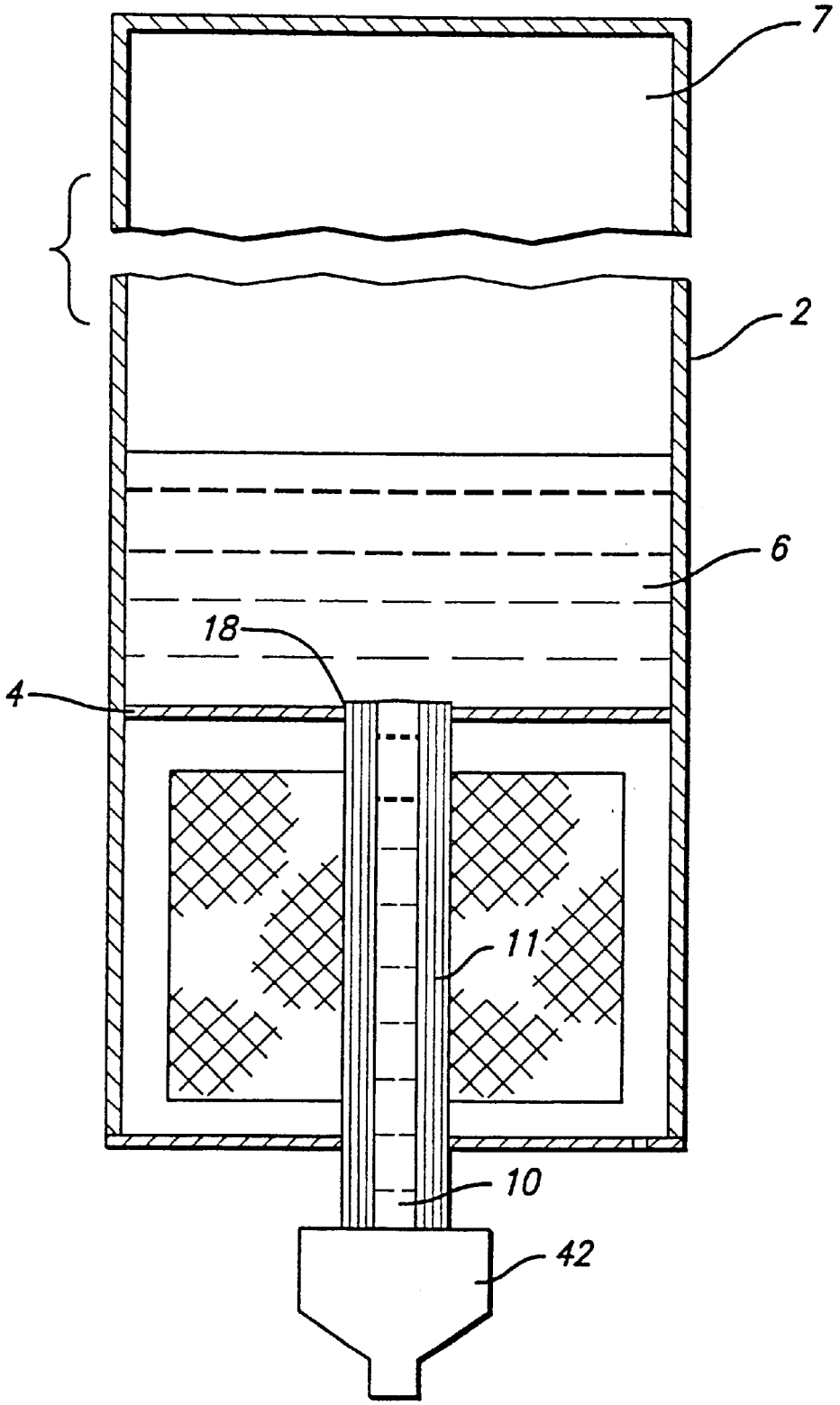
FIG. 9 is a view in cross-section through an implement similar to FIG. 1, the applicator element being in the form of a printing element.

The embodiment of FIG. 9 corresponds to that of FIG. 5 but here the hollow wick 11 terminates directly in a printing element 42 serving as the applicator element. While the embodiments of FIGS. 1 to 8 are intended for a mode of operation in which the liquid is applied to the support by mechanical contact and relative movement between the writing tip 12 and the support, the implement of FIG. 9 operates in such a way that the printing element 42 is connected to an electrical actuating device (not shown) for spraying quantities of liquid on to a support in a deliberate and targeted manner.

Figure 10:
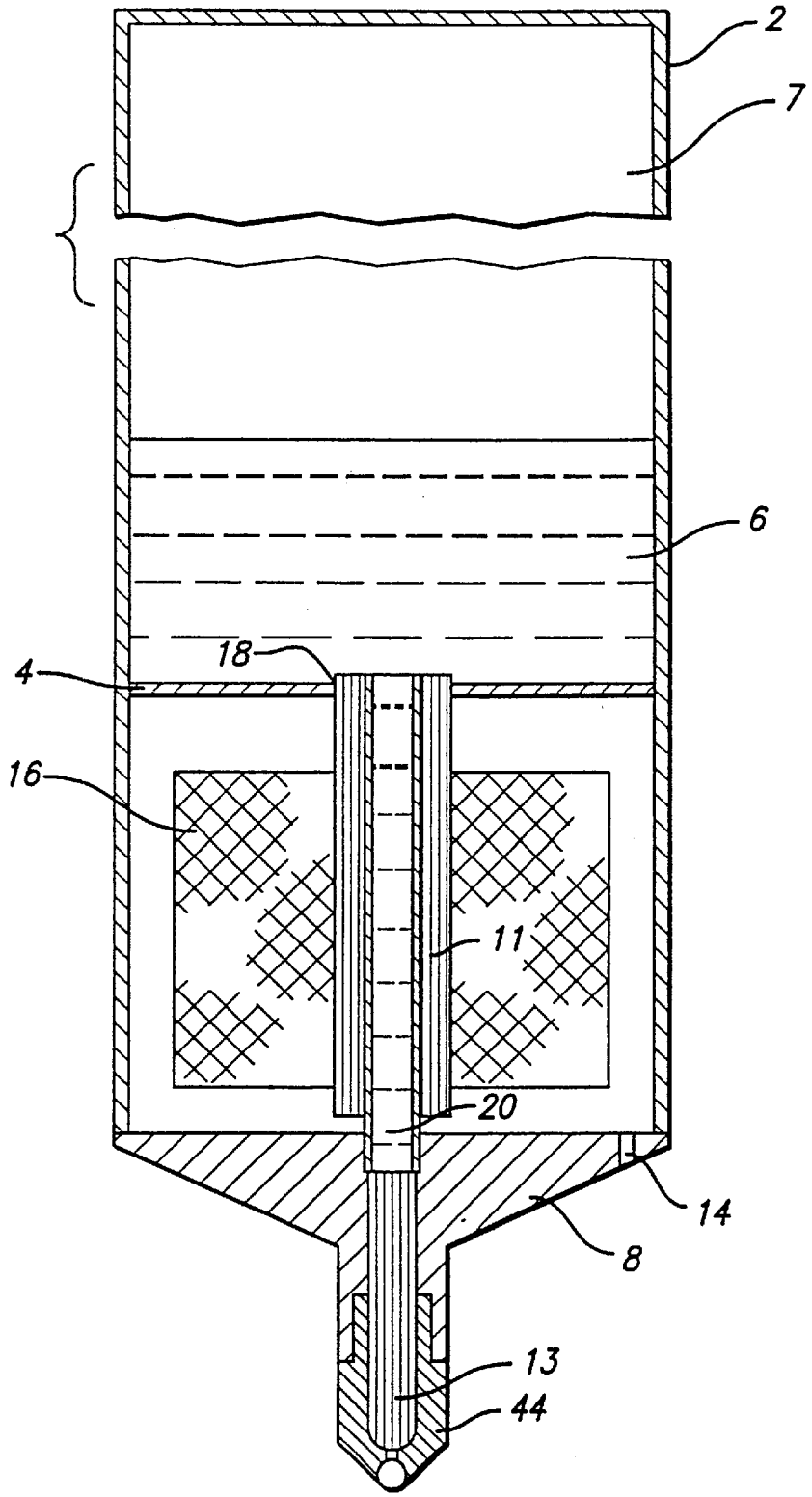
FIG. 10 is a view in cross-section through an implement similar to FIG. 2, the applicator element being in the form of a ball point tip.

The embodiment of the implement shown in FIG. 10 corresponds to that shown in FIG. 5, with the exception that fitted into the front portion 8 is a per se known ball point tip 44 which is applied with writing liquid directly from the writing tip 13 of the embodiment shown in FIG. 5, which is in the form of a wick portion.

In all embodiments of the implement according to the invention as shown in FIGS. 1 to 10 it is possible to use the most widely varying applicator elements such as felt pen tips, fine painting and drawing tips, brush tips, printing elements, ball point tips, other writing tips and the like.

Instead of the wicks of wick portions it is also possible to use individual capillary passages or ducts whose capillarity corresponds to the mean capillarity of the wick replaced thereby such capillary passages or ducts extend in functional terms parallel to the wick or transversely through the wick which they replace, depending on the function which they perform. For example in the embodiment of FIG. 5 the hollow wick 11 can be replaced by a passage or duct which performs the function of the passage 20. One or more capillary passages or ducts which connect the passage 20 to the storage means 16 can lead transversely through the wall of the passage or duct which replaces the hollow wick 11.

It will be appreciated that the above-described embodiments of the invention have been set forth solely by way of example and that various modifications may be made therein without thereby departing from the scope of the invention.

What is claimed is:

1. An implement for applying liquid to a support, comprising:

a container having a wall defining a first storage area for storing liquid and a second storage area, the wall having an opening and a first capillary slot;

a tip;

a capillary wick extending from the opening to the tip;

a capillary storage within the second storage area and at least a portion of the second storage is in direct contact with the capillary wick, wherein the first capillary slot has a defined capillarity that is lower than an average capillarity of the capillary wick but is greater than an average capillarity of the capillary storage.

2. An implement according to claim 1, wherein the capillary wick completely fills the opening.

3. An implement according to claim 1, wherein the first capillary slot extends from the opening.

4. An implement according to claim 1, wherein the container has at least one vent bore lateral from the capillary wick near the tip.

5. An implement according to claim 1, wherein the capillary storage is separated from the first storage area such that the capillary storage only comes into contact with the liquid from the first storage only through the capillary wick.

6. An implement according to claim 1, wherein the capillary wick has a passage within at least a portion of the capillary wick.

7. An implement according to claim 1, wherein the first capillary slot allows air to enter thereof for compensate of liquid taken from the first storage area of the container.

8. An implement according to claim 1, wherein the wall has a second capillary slot, wherein the second capillary slot has a defined capillarity that is lower than an average capillarity of the capillary wick but is greater than an average capillarity of the capillary storage.

9. An implement according to claim 1, wherein the second capillary slot extends from the opening.

10. A method of compensating for liquid leaving a liquid storage container of a writing instrument, comprising:

opening a liquid storage container;

filling the opening with a capillary wick having an average capillarity to transfer liquid from the liquid storage container to a tip;

storing excess liquid from the liquid storage area in a capillary storage in direct contact with the capillary wick;

feeding air to the liquid storage container through a capillary slot having a defined capillarity that is lower than the average capillarity of the capillary wick but is greater than the average capillarity of the capillary storage to substantially maintain a predetermine vacuum pressure within the liquid storage container.

11. A method according to claim 10, wherein the opening is formed in a wall between the liquid storage container and the capillary storage, wherein the capillary slot is formed on the wall.

12. A method according to claim 11, wherein the capillary slot extends outwardly from the opening.

13. A method according to claim 10, wherein the opening is formed in a wall between the liquid storage container and the capillary storage, wherein the capillary slot is formed between the capillary wick and the wall.

* * * * *